US007559624B2

(12) United States Patent
Reinten

(10) Patent No.: US 7,559,624 B2
(45) Date of Patent: Jul. 14, 2009

(54) PRINTER DEVICE AND CONTROL METHOD THEREOF

(75) Inventor: Hans Reinten, Velden (NL)

(73) Assignee: Oce-Technologies B.V., Venlo (NL)

( * ) Notice: Subject to any disclaimer, the term of this patent is extended or adjusted under 35 U.S.C. 154(b) by 199 days.

(21) Appl. No.: 11/322,321

(22) Filed: Jan. 3, 2006

(65) Prior Publication Data

US 2006/0146078 A1 Jul. 6, 2006

(30) Foreign Application Priority Data

Jan. 4, 2005 (EP) ..... 05100024

(51) Int. Cl.
*B41J 2/15* (2006.01)

(52) U.S. Cl. ..... 347/41; 347/40; 347/12; 347/15; 347/5

(58) Field of Classification Search ..... 347/40–43, 347/5, 12, 15

See application file for complete search history.

(56) References Cited

U.S. PATENT DOCUMENTS 5,070,345 A * 12/1991 Lahut et al. ..... 347/41
6,170,932 B1 * 1/2001 Kanaya et al. ..... 347/41

FOREIGN PATENT DOCUMENTS

EP 1 228 881 A2 8/2002

* cited by examiner

*Primary Examiner*—Matthew Luu
*Assistant Examiner*—Henok Legesse
(74) *Attorney, Agent, or Firm*—Birch, Stewart, Kolasch & Birch, LLP

(57) ABSTRACT

A printing device with at least one bi-directional scanning print head can print images on an image-receiving member in multiple traverses. After each traverse, the image-receiving member is displaced with respect to the print head in the sub scanning direction over a predetermined displacement distance. By selecting for each traverse of the print head an active portion thereof taking account of the displacement step between subsequent traverses, on substantially each position of the image-receiving member, the traversing direction of the print head is the same for each first exposure to an active portion of the traversing print head.

8 Claims, 7 Drawing Sheets

| | | | |
|---|---|---|---|
| 1 | 1 | 1 | 1 |
| 1 | 1 | 1 | 2 |
| 1 | 2 | 2 | 2 |
| 2 | 2 | 2 | 2 |

first printing stage second printing stage first printing stage second printing stage stage 1 stage 2 stage 3

PRINTER DEVICE AND CONTROL METHOD THEREOF

CROSS-REFERENCE TO RELATED APPLICATIONS

This nonprovisional application claims priority under 35 U.S.C. § 119(a) on European Patent Application No. 05100024.8, filed on Jan. 4, 2005, the entirety of which is incorporated herein by reference.

BACKGROUND OF THE INVENTION

1. Field of the Invention

The present invention is related to a printing device such as a printing or copying system employing print heads containing discharging elements, e.g. nozzles, for image-wise forming dots of a marking substance on an image-receiving member, where the marking substance is in fluid form when discharged. Examples of such printing devices are inkjet printers and toner-jet printers. Hereinafter reference will be made to inkjet printers.

2. Description of Background Art

Print heads employed in inkjet printers and the like usually each contain a plurality of nozzles arranged in (an) array(s). The nozzles usually are placed substantially equidistant. The distance between two contiguous nozzles defines the nozzle pitch. In operation, the nozzles are controlled to image-wise discharge fluid droplets of a marking substance on an image-receiving member. When the printer is of the scanning type, the print heads are moveable in reciprocation across the image-receiving member, i.e. the main scanning direction. In such printers, the print heads are typically aligned in the sub scanning direction perpendicular to the main scanning direction. A matrix of image dots of a marking substance, corresponding to a part of an original image, is formed on the image-receiving member by image-wise activating nozzles of the print heads in a traverse of the print heads across the image-receiving member. The printed matrix is generally referred to as a print swath, while the dimension of this matrix in the sub scanning direction is referred to as the swath width. Usually, although not required, the printing swath is constant within a selected printing mode. After a first traverse, when a part of the image is completed, the image-receiving member is displaced relative to the print heads in the sub-scanning direction enabling printing of a subsequent part of the image. When this displacement step is chosen equal to a swath width, an image can be printed in multiple non-overlapping swaths. An advantage of such approach is high productivity, since only a single traverse or printing stage is employed. However, image quality may be improved by employing printing devices enabling the use of multiple printing stages. In the background art, two main categories of such printing devices can be distinguished, i.e. so-called "interlace systems" and "multi-pass systems".

In an interlace system, the print head contains N nozzles, which are arranged in (a) linear array(s) such that the nozzle pitch is an integer multiple of the printing pitch. Multiple printing stages, or so-called interlacing printing steps, are required to generate a complete image or image part. The print head and the image-receiving member are controlled such that in M printing stages, M being defined here as the nozzle pitch divided by the printing pitch, a complete image part is formed on the image-receiving member. After each printing stage, the image-receiving member is displaced over a distance of M times the printing pitch. Such a system is of particular interest because it achieves a higher print resolution with a limited nozzle resolution.

In a "multi-pass system", the print head is controlled such that only the nozzles corresponding to selected pixels of the image to be reproduced are image-wise activated. As a result, an incomplete matrix of image dots is formed in a single printing stage or pass, i.e. one traverse of the print heads across the image-receiving member. Multiple passes are required to complete the matrix of image dots. The image-receiving member may be displaced in the sub scanning direction in-between two passes.

Both "interlace systems" and "multi-pass systems" as well as combinations thereof share the advantage of an improved image quality but also the inherent disadvantage of a lower productivity because multiple printing stages are required to render an image part. In practice, the majority of print jobs are executed in such multiple printing stage mode on a scanning type bi-directional printing system, i.e. a printing system capable of printing on the image-receiving member during reciprocation in the main scanning direction.

Such systems are known to be sensitive to gloss variations. Gloss variations can occur when at least a part of the image dots of a marking substance of the same or a different process color are deposited in multiple printing stages in superimposition or at least partially overlapping and when the drying time of the image dots printed on the image-receiving member interacts with the time period required to render all pixels of an image part, i.e. the time period required to complete a sequence of printing stages defined by the print mask. The so-called print mask contains the information about the number and sequence of printing stages and defines which nozzles can be image-wise activated, or in other words contains the information that defines which pixels will be rendered by which nozzles for each printing stage, such that when all printing stages are completed, all the pixels of the image part concerned are rendered. A print mask is associated with a printing mode. Selecting a printing mode enables the user to exchange image quality for productivity and vice versa depending on his requirements. By selecting a printing mode, the nozzles on the print heads, which may be effectively used, are determined as well as the displacement step in the sub scanning direction after each printing stage.

It is known to reduce gloss variations by configuring print masks, which ensure that each position in the sub scanning on the image-receiving member where the image part is to be rendered is exposed to respective printing stages in the same sequence. For instance, suppose a print mask defining four printing stages having, e.g. a sequence 4, 3, 2, 1 is used, each followed by a displacement step of 25% of the swath width. This means that there are positions in the sub scanning on the image-receiving member where the image part is to be rendered that are subjected first to printing stage 4 and subsequently to printing stages 3, 2, 1, while there are also positions in the sub scanning direction on the image-receiving member where the image part is to be rendered that are subjected first to printing stage 3 and subsequently to printing stages 2, 1, 4. For instance, printing stages 4 and 2 may correspond to a traverse of the print head from the left to the right, and by consequence printing stages 3 and 1 correspond to a traverse from the right to the left. It is therefore clear that, although superimposed or partially overlapping image dots on the image-receiving member are deposited in the same sequence, the time intervals between the deposition of the respective image dots are clearly position dependent. This is believed to cause significant gloss variations in the printed images.

SUMMARY OF THE INVENTION

Thus, it is an object of an embodiment of the invention to control a scanning type bi-directional printing system when operating in a multiple printing stage mode such as to overcome or at least reduce gloss variations in a printed image while limiting the influence on productivity.

It is a further object of an embodiment of the invention to control the print heads and the image-receiving member displacement device of a scanning type bi-directional printing system such that, particularly when operating in a multiple printing stage mode at each location on the image-receiving member in the sub-scanning direction, about the same time intervals are used between the time of deposition of the respective image dots which when deposited are in superimposition or at least partially overlapping.

To meet these objects, a printing device for printing images on an image-receiving member in multiple printing stages, includes a control that selects for each said traverse of the print head in the main scanning direction an active portion of the plurality of discharging elements and for controlling image-wise activation thereof, wherein each active portion of discharging elements is selected on the basis of the predetermined distance so that for substantially each position in the sub scanning direction on the part of the image-receiving member where the image is to be rendered, the traversing direction of the print head is the same for each first exposure to an active portion of the traversing print head.

Each traverse of the print head in an operative state results in a printed portion of an image on the image-receiving member formed by a pattern of image dots of a marking substance. After each traverse, the image-receiving member is displaced with respect to the print head in the sub scanning direction either by displacing the image-receiving member or by displacing the print head. When printing subsequent portions of an image, a repetitive sequence of printing stages and corresponding displacement steps is used. Each displacement step is defined by the relative displacement between the print head and the image-receiving member over a predetermined distance between respective subsequent printing stages. In particular, each of the displacement steps may be chosen equal to the same constant.

By selecting an active portion of the print head for each traverse of the print head, taking account of the displacement step between subsequent traverses, an embodiment of the present invention ensures that the traversing direction of the print head is the same for each first exposure to an active portion of the traversing print head on substantially each position of the image-receiving member. The advantage thereof is that in the sub-scanning direction there are no time interval differences between the time of deposition of image dots originating from different traverses. Hence no gloss variations will occur or they will be at least severely reduced.

The image-receiving member may be an intermediate image carrying member or a print medium. The print medium can be in web or sheet form and may be composed of e.g. paper, cardboard, label stock, plastic or textile.

In an embodiment of the invention, the selected active portion for a forward traverse is different from the selected active portion for a backward traverse. Preferably a same active portion is selected for each forward traverse, while also a same active portion is selected for a backward traverse. This is believed to reduce print strategy complexity and to be less prone to errors. For instance, the active portion in a forward traverse may be either the upper part or the lower part of the print head while the active portion in a backward traverse is the other one of said upper part or said lower part of the print head.

In another embodiment of the invention, each active portion is selected such that the product of the number of discharging elements available in the active portion and the discharging element pitch is a non-zero integer multiple of the displacement distance.

In another embodiment of the invention, a print mask is employed defining an even number of printing stages. In that case each active portion may be selected such that the swath width of each printed portion of an image is equal. An advantage hereof is that such print strategy in most cases achieves a higher print productivity, since a higher number of nozzles can be image-wise activated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

In relation to the appended drawings, the present invention is described in detail in sequence. Several embodiments are disclosed. It is apparent however that a person skilled in the art can imagine several other equivalent embodiments or other ways of executing the present invention, the scope of the present invention being limited only by the terms of the appended claims.

Figure 1:
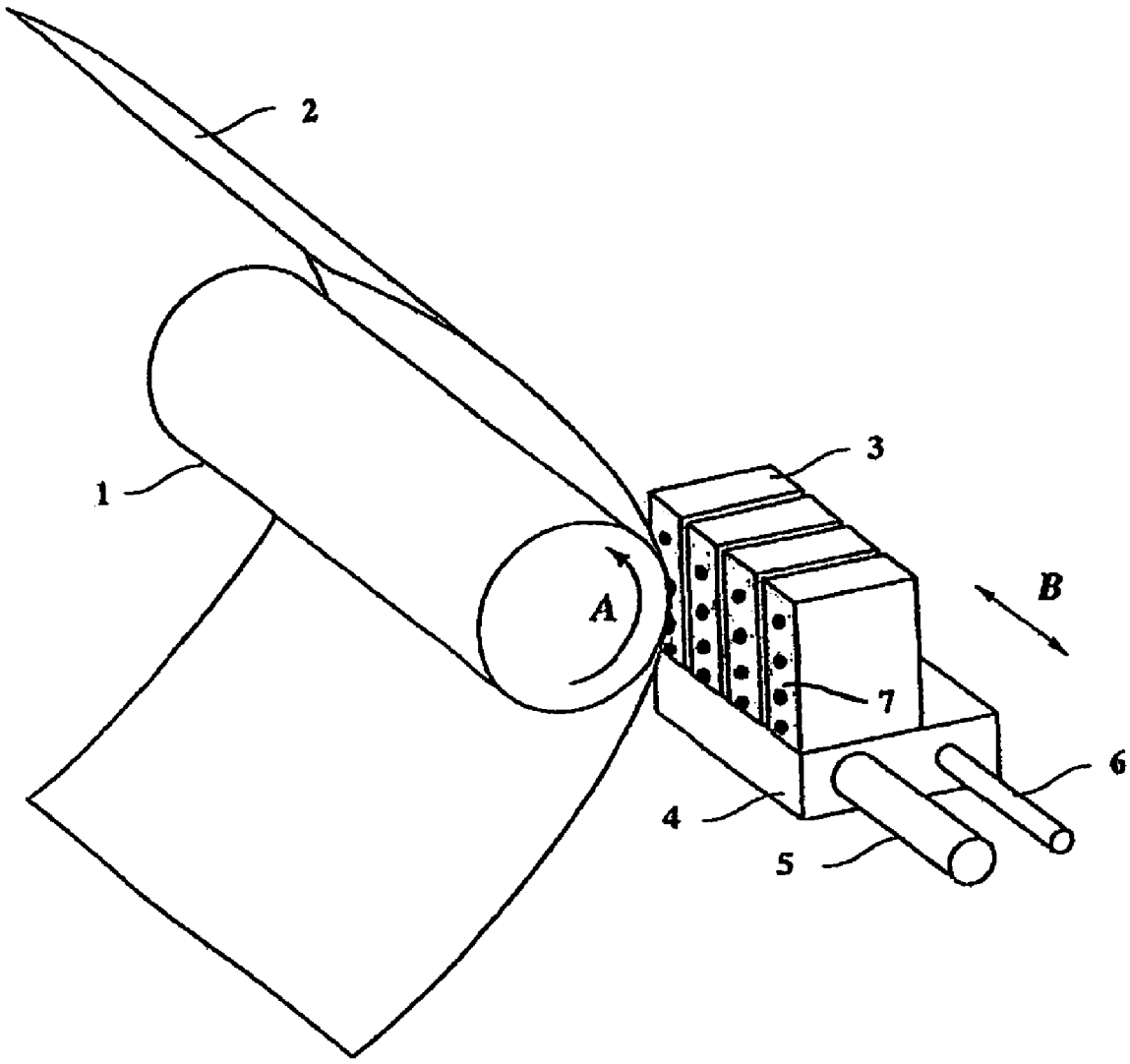
FIG. 1 depicts an example of an inkjet printer according to an embodiment of the present invention.

The printing device of FIG. 1 is a scanning bi-directional inkjet printer including a roller (1) for supporting an image-receiving member (2) and moving the image-receiving member (2) along four print heads (3). Each of the four print heads (3) is of a different process color. The roller (1) is rotatable about its own axis as indicated by arrow A. A scanning carriage (4) carries the four print heads (3) and can be moved in reciprocation in the main scanning direction, i.e. the direction indicated by the double arrow B, parallel to the roller (1), such as to enable scanning of the image-receiving member (2) in the main scanning direction. The image-receiving member (2) can be a medium in web or in sheet form and may be composed of e.g. paper, cardboard, label stock, plastic or textile. Alternately, the image-receiving member (2) can also be an intermediate member, endless or not. Examples of endless members, which can be moved cyclically, are a belt or a drum. The carriage (4) is guided on rods (5) (6) and is driven by suitable means (not shown). Each print head (3) includes a number of discharging elements (7) arranged in a single linear array parallel to the sub scanning direction. Four discharging elements (7) per print head (3) are depicted in the figure; however, it is obvious that in a practical embodiment several hundreds of discharging elements would typically be provided per print head (3). Each discharging element (7) is connected via an ink duct to an ink reservoir of a corresponding color. Each ink duct is provided with a mechanism for activating the ink duct and an associated electrical drive circuit. For instance the ink duct may be activated thermally and/or piezoelectrically. When the ink duct is activated, an ink drop is discharged form the discharge element (7) in the direction of the roller (1) and forms a dot of ink on the image-receiving member (2).

To enable printing, first, a digital image is formed. There are numerous ways to generate a digital image. For instance, scanning an original using a scanner may create a digital image. A camera or a video camera may also create digital still images. Besides digital images generated by a scanner or a camera, which are usually in a bitmap format or a compressed bitmap format also artificially created, e.g. by a computer program, digital images or documents may be offered to the printing device. The latter images can be in a vector format. The latter images can also be in a structured format including but not limited to a page description language (PDL) format and an extensible markup language (XML) format. Examples of a PDL format are PDF (Adobe), PostScript (Adobe), and PCL (Hewlett-Packard). The image processing system typically converts a digital image with known techniques into a series of bitmaps in the process colors of the printing device. Each bitmap is a raster representation of a separation image of a process color specifying for each pixel ("picture element") an image density value for said process color. An image composed of ink dots can be formed on the image-receiving member by image-wise activating the ink ducts in relation to the pattern(s) of image pixels.

EXAMPLE 1

A printing device as depicted in FIG. 1 is used to reproduce a digital image. Each print head is provided with 24 discharging elements, i.e. nozzles, arranged in a single linear array, instead of using the print heads 3 provided with four discharging elements as in FIG. 1. The nozzles are positioned equidistant at a resolution of 300 npi (nozzles per inch). This means that the nozzle pitch or element pitch, being the distance between the centers of two adjacent nozzles is about 85 μm.

Figures 2A, 2B:
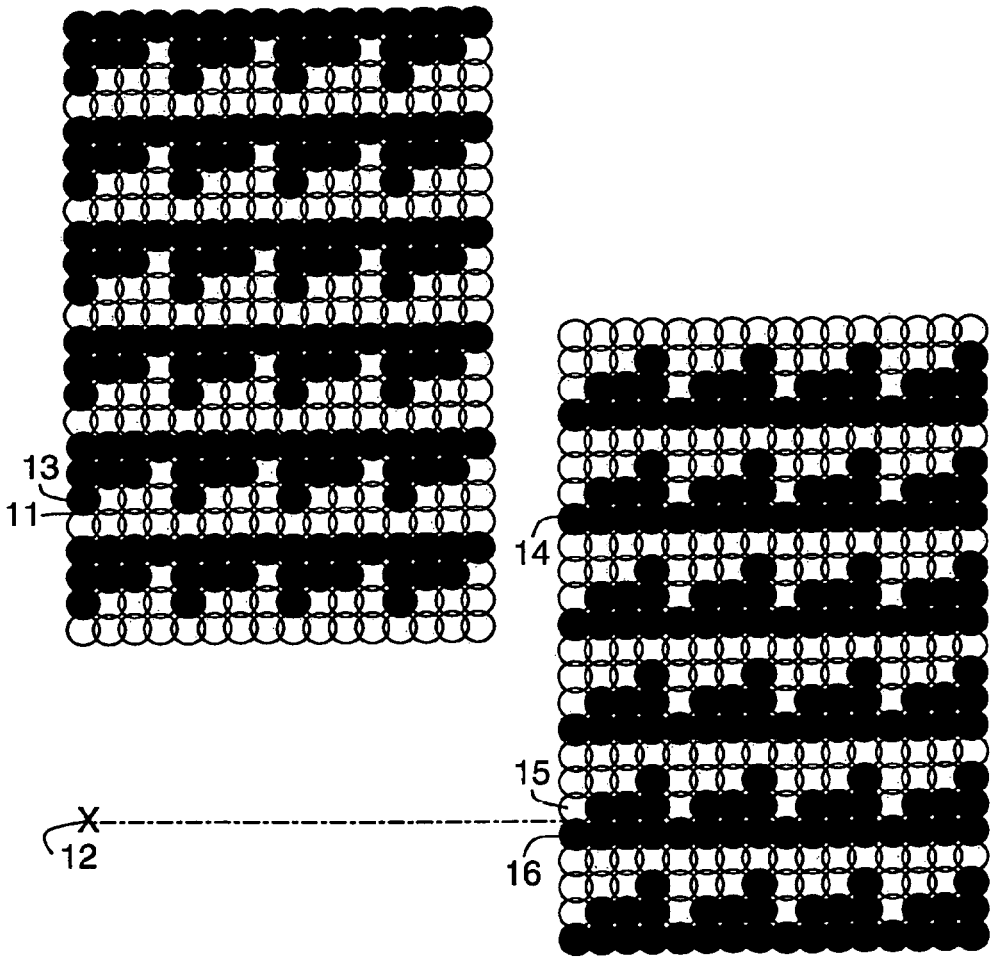
FIG. 2*a* depicts an example of a print mask defining two printing stages.
FIG. 2*b* depicts image dot patterns generated by a single print head assuming a full coverage image using all 24 nozzles of the print head and using the print mask of FIG. 2*a;*

Suppose the user selects a particular printing mode that enables reproduction of a digital image at a printing resolution of 300 dpi (dots per inch) in both the main scanning and the sub scanning directions. In other words, the printing pitch, i.e. the distance between the centers of two contiguous dots of ink both in the main scanning direction and in the sub scanning direction, is about 85 μm. In this printing mode, the print mask as depicted in FIG. 2*a* is used. In case the image is a multicolor image, the same print mask is used for each of the process colors. The print mask as depicted in FIG. 2*a* defines a "multi-pass" system with two printing stages. As depicted in FIG. 2*b*, in the first printing stage, a first portion of the image is printed by image-wise activating selected nozzles of the active portion of the print head 3. The image pattern resulting when activating all selected nozzles is indicated in FIG. 2*b* with black circles. In this case, the active portion includes all 24 available nozzles. This first printing stage coincides with a forward traverse of the print heads across the image-receiving member, i.e. a traverse from the left to the right. Then, the image-receiving member is advanced over a predetermined constant distance to enable printing of a second portion of the image by image-wise activating a different selection of nozzles of the same active portion. The image pattern resulting when activating all selected nozzles according to the second printing stage is indicated in FIG. 2*b*. This second printing stage coincides with a backward traverse of the print heads across the image-receiving member, i.e. a traverse from the right to the left. When the image is not yet completed, the image-receiving member is again advanced over the same constant distance being 12 times the nozzle pitch. Thereafter, the above-described sequence of printing stages and image-receiving member advancing is repeated until the last portion of the image is completed.

Although each position in the sub scanning direction on the image-receiving member is subjected to the same sequence of printing stages, the time intervals between the deposition of the respective image dots are clearly position dependent. For instance, let us consider two image positions on the left side of the image-receiving member, being positions (11) and (12). Position (11) is first subjected to printing stage 1, i.e. a traverse of the print heads from left to right. When the print heads are at the left side of the image-receiving member image dot(s) (13) are formed at position (11). When printing stage 1 is completed, the print heads are at or past the right hand side of the image-receiving member. Then, the image-receiving member is displaced over a distance of twelve times the nozzle pitch. Subsequently, the second printing stage is executed, i.e. the print heads traverse from the right to the left of the image-receiving member. When the print heads arrive again at the left hand side of the image-receiving member, image dot(s) (14) are formed such that at position (11) image dots (13) and (14) at least partially overlap. Hence, the total time between the formation of overlapping dots (13) and (14) at position (11) is in addition to image-receiving member advancing about twice the travel time of the print heads across the image-receiving member. Position (12) on the image-receiving member is first subjected to printing stage 2, i.e. a traverse of the print heads from the right to the left. When the print heads are at the left side of the image-receiving member image dot(s) (16) are formed at position (12). When printing stage 2 is completed, the print heads are at or past the left hand side of the image-receiving member. Then, the image-receiving member is displaced over a distance of twelve times the nozzle pitch. Subsequently, the first printing stage is executed, i.e. the print heads traverse from the left to the right of the image-receiving member. At the beginning of this traverse, when the print heads are still at the left hand side of the image-receiving member, image dot(s) corresponding with image dot position (15) are formed such that at position (12) image dots (15) and (16) at least partially overlap. Hence, the total time between the formation of overlapping dots (16) and (15) at position (12) is about the time required to advance the image-receiving member over a distance of 12 times the nozzle pitch. It is thus clear that the time intervals between the deposition of the respective image dots at different locations on the image-receiving member in the sub scanning direction are clearly position dependent. This is believed to cause significant gloss variations in the printed images.

Figure 3A:
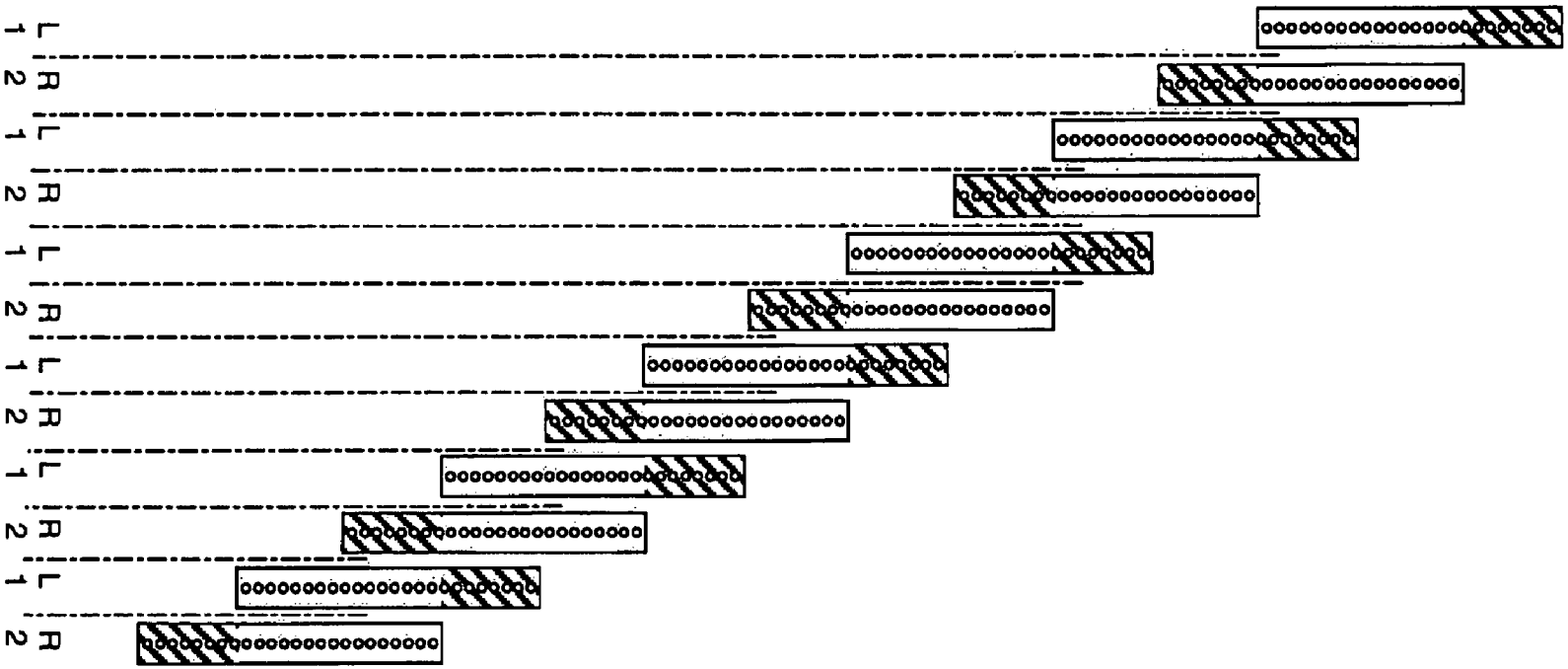
FIG. 3*a* depicts, according to an embodiment of the present invention, which active portion of the print head will be used for respective traverses/printing stages used.
Figure 3B:
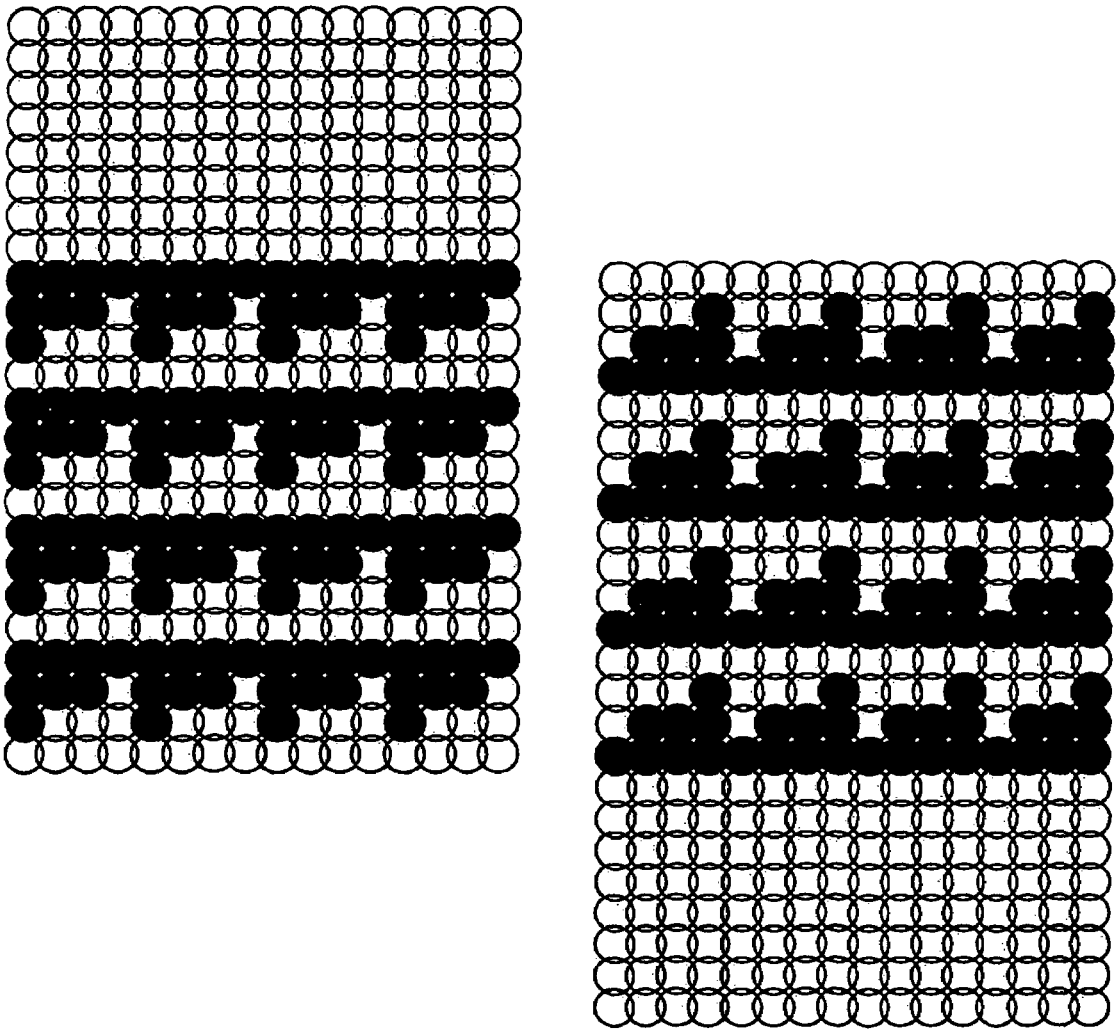
FIG. 3*b* depicts, according to and embodiment of the present invention, image dot patterns generated by a single print head assuming a full coverage image, using in each traverse a selected active portion of the print head as in FIG. 3*a* and using the print mask of FIG. 2*a;*

Hence, according to the present invention, for each printing stage, i.e. for each traverse of a print head(s) in the main scanning direction an active portion of the plurality of available discharging elements of the print head is selected. As indicated in FIG. 3*a*, in the first printing stage, i.e. a traverse from the left to the right, the active portion includes the lower 16 nozzles, while the inactive portion includes the upper eight nozzles. When executing a first printing stage using the same print mask as depicted in FIG. 2*a* a dot pattern as schematically depicted in FIG. 3*b* is obtained. After the first printing stage is executed, the image-receiving member is advanced over a distance of 8 times the nozzle pitch. It is thus observed that the 16 lower nozzles in the print head constituting the active portion in the first printing stage multiplied with the nozzle pitch is two times the image-receiving member advancement distance. After the displacement step, the second printing stage is executed. In this second printing stage, i.e. a traverse from the right to the left, the active portion includes the upper 16 nozzles, while the inactive portion includes the lower eight nozzles. A dot pattern as schematically depicted in FIG. 3*b* is obtained. In practice when the complete image is not yet printed, the image-receiving member will be advanced again over a distance of 8 times the nozzle pitch and subsequently the above described sequence of printing stages and image-receiving member advancement would be repeated until the image is completed. As can be observed in FIG. 3*b*, the selection of the active portions in the forward and backward traverses respectively takes account of the image-receiving member displacement step so that for each position in the sub scanning direction on the part of the image-receiving member where the image is to be rendered, the traversing direction of the print head is the same for each first exposure to an active portion of the traversing print head.

EXAMPLE 2

A printing device as depicted in FIG. 1 is used to reproduce a digital image. Each print head is provided with 12 discharging elements, i.e. nozzles, arranged in a single linear array, instead of using the print heads 3 provided with four discharging elements as in FIG. 1. The nozzles are positioned equidistant at a resolution of 300 npi (nozzles per inch). This means that the nozzle pitch or element pitch, being the distance between the centers of two adjacent nozzles is about 85 μm.

Suppose the user selects a particular printing mode that enables reproduction of a digital image at a printing resolution of 900 dpi (dots per inch) in both directions. In other words, the printing pitch, i.e. the distance between the centers of two contiguous dots of ink both in the main scanning direction and in the sub scanning direction, is about 31 μm. To enable rendering of an image with a resolution higher than the nozzle resolution, the print mask associated with the selected printing mode as in FIG. 4*a* defines an interlacing system. The print mask defines a sequence of three printing stages required to completely render at least a part of the image. As depicted in FIG. 4*b*, in the first printing stage, labelled as 1 in FIG. 4*a*, a first portion of the image is printed by image-wise activating selected nozzles of the active portion of the print head. In this case the active portion includes all 12 available nozzles. This first printing stage coincides with a forward traverse of the print heads across the image-receiving member, i.e. a traverse from the left to the right. The image pattern resulting when activating all selected nozzles is indicated in FIG. 4*b* with black circles. For instruction purposes, only the dots generated by a single print head are shown and a full coverage image is assumed. In practice however, it is clear that images can be formed in the same way multi-color images are formed by adequately timing both the driving of the respective print heads and the image-wise activation of the associated nozzles. Each nozzle image-wise forms a complete line of image dots of ink in the main scanning direction. In the sub scanning direction only every third pixel is printed during the first printing stage. After the first printing stage the image-receiving member is displaced over a distance of 11 times the printing pitch. Then, the second printing stage is executed to print the second portion of the image part. This second printing stage coincides with a traverse of the print head from the right to the left. The image pattern resulting is schematically depicted in FIG. 4*b*. To complete the image part, again the image-receiving member is advanced over a distance of 11 times the printing pitch and the third printing stage, i.e. a traverse of the print head from the left to the right, is executed. When the image is not yet completed, the image-receiving member is again advanced but then over a distance of 14 times the printing pitch. Thereafter, the above-described sequence of printing stages and image-receiving member advancing is repeated until the image is completed. When looking at the resulting image patterns in FIG. 4*b*, it is clear that although each position in the sub scanning direction on the image-receiving member is subjected to the same sequence of printing stages, the time intervals between the deposition of the respective image dots in the sub scanning direction depends on the position on the image-receiving member, which as stated before may result in gloss banding.

Figure 5A:
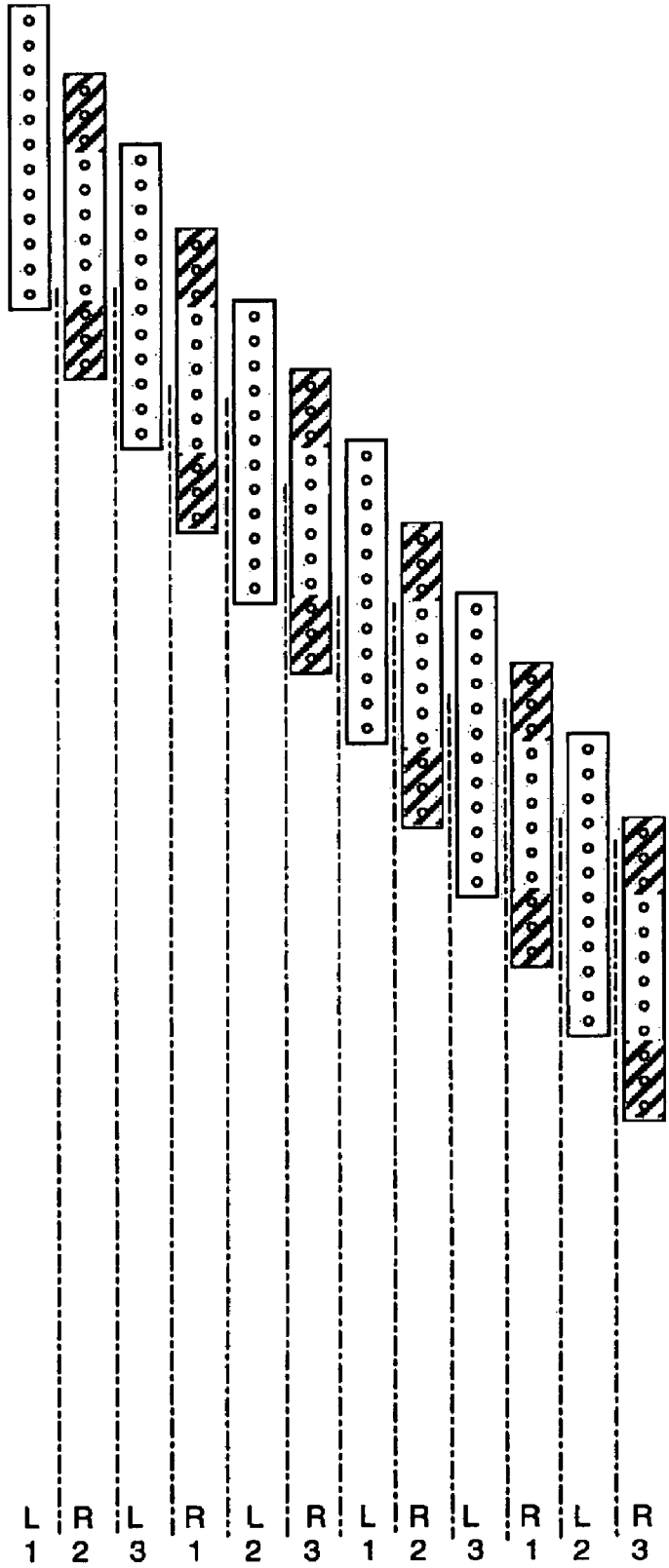
FIG. 5*a* depicts, according to an embodiment of the present invention, which active portion of the print head will be used for respective traverses/printing stages used.

Hence, according to an embodiment of the present invention, for each printing stage, i.e. for each traverse of a print head(s) in the main scanning direction, an active portion of the plurality of available discharging elements of the print head 3 is selected. In particular, as also depicted in FIG. 5*a*, when a printing stage coincides with a traverse of the print head from the left to the right, the active portion includes all 12 available nozzles. When a printing stage coincides with a traverse of the print head from the right to the left, the active portion includes the six nozzles located in the middle of the print head while the upper three nozzles as well as the lower three nozzles are part of the inactive portion. In this example, the active portion in each forward traverse and the active portion in each backward traverse are selected such that the swath width of each portion of an image printed in the forward traverse is twice the swath width of each portion of an image printed in the backward traverse. In general, when printing an image with an uneven number of printing stages, M, the active portion in each forward traverse and the active portion in each backward traverse are selected such that the ratio of the swath width of each portion of an image printed in the forward traverse and the swath width of each portion of an image printed in the backward traverse is M+1 divided by M−1 or vice versa.

Figure 4A:
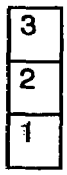
FIG. 4*a* depicts an example of a print mask defining three printing stages.
Figure 4B:
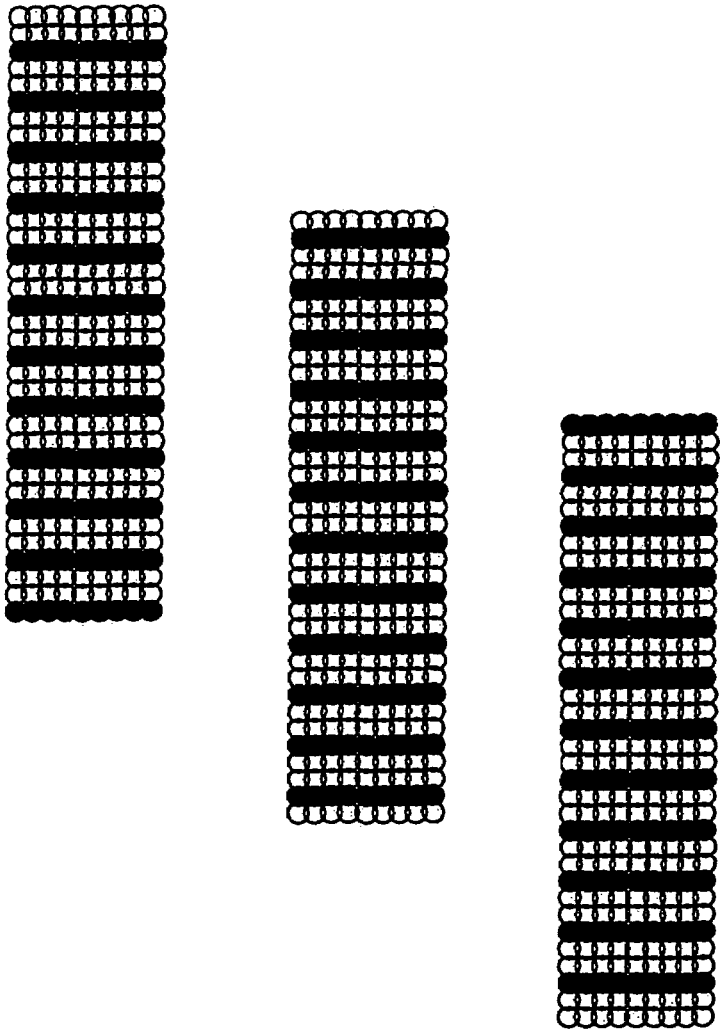
FIG. 4*b* depicts image dot patterns generated by a single print head assuming a full coverage image, using all 12 nozzles of the print head and using the print mask of FIG. 2*a;*

Note that with a print mask as depicted in FIG. 4*a* the inactive portions of the print head in each traverse make up a completely filled bitmap with a resolution of 300 dpi. Thus the nozzles of these inactive portions can be used to compensate for any failing nozzle with no position error or at most an absolute position error of one print pitch.

Figure 5B:
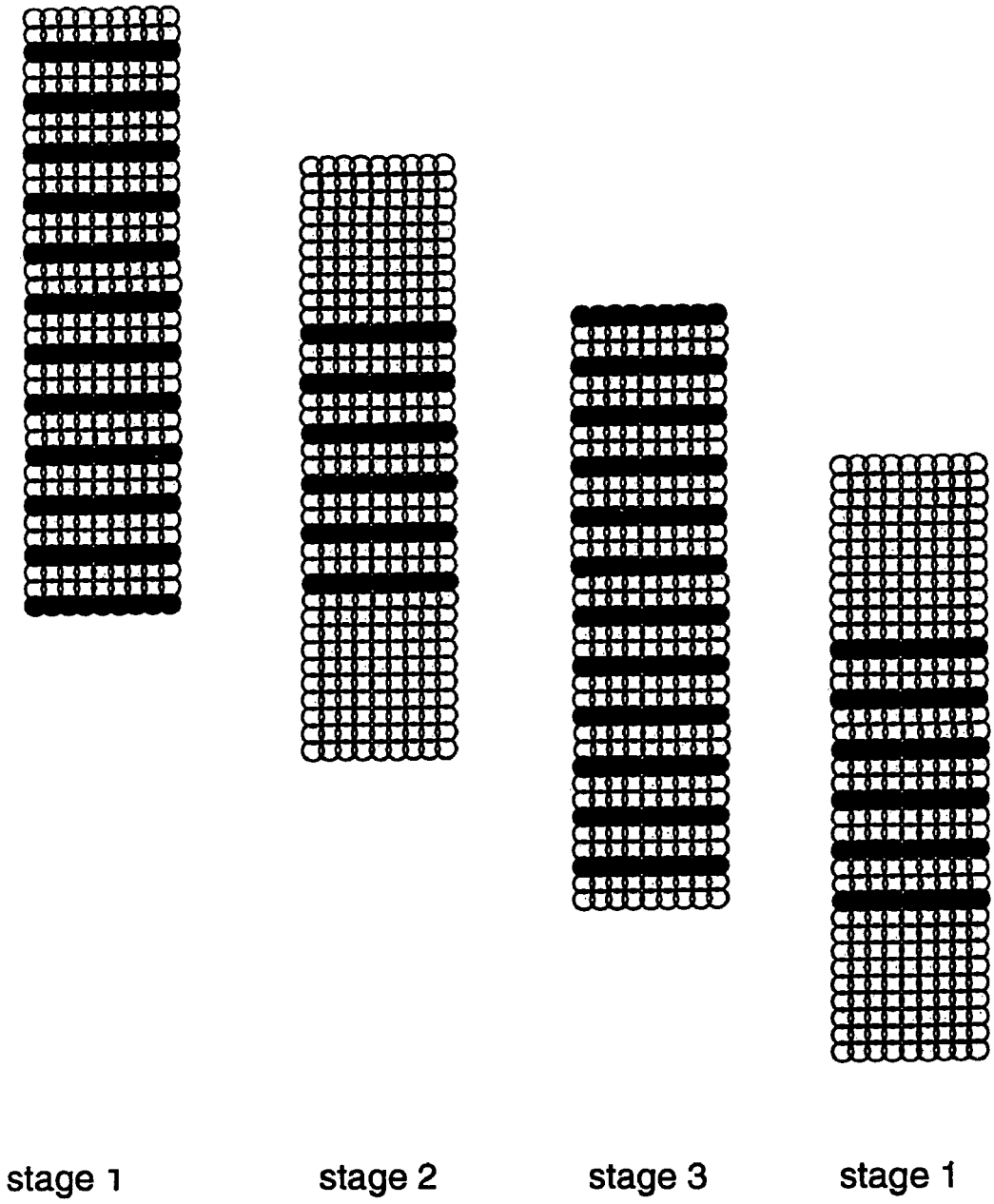
FIG. 5*b* depicts, according to an embodiment of the present invention, image dot patterns generated by a single print head assuming a full coverage image using in each traverse a selected active portion of the print head as in FIG. 5*a* and using the print mask of FIG. 4*a*.

When executing a first printing stage using the same print mask as depicted in FIG. 4*a*, a dot pattern as schematically depicted in FIG. 5*b* is obtained. After the first printing stage is executed, the image-receiving member is advanced over a distance of 8 times the printing pitch. After the displacement step, the second printing stage is executed. In this second printing stage, i.e. a traverse from the right to the left, the active portion includes the 6 nozzles located in the middle of the print head, while the inactive portion includes both the lower and upper three nozzles. A dot pattern as schematically depicted in FIG. 5*b* is obtained. After the second printing stage is executed, the image-receiving member is again advanced over a distance of 8 times the printing pitch.

In the third printing stage, in this case a traverse from left to right again, the full print head is employed. Subsequently, the image-receiving member is again advanced but this time over a distance of 11 times the printing pitch. Afterwards, the next printing step is executed. This is again printing stage 1, which is however in this case a traverse from the right to the left and thus only the 6 nozzles in the middle of the print head are used. In practice the above described printing stages, being stages 1, 2 and 3, and associated advancement steps, being 8, 8 and 11 printing pitches, are repeated until the entire image is printed. As can be observed in FIG. 5*b*, the selection of the active portions in the forward and backward traverses respectively takes account of the image-receiving member displacement step so that for each position in the sub scanning direction on the part of the image-receiving member where the image is to be rendered, the traversing direction of the print head is the same for each first exposure to an active portion of the traversing print head.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printing device for printing images on an image-receiving member in multiple printing stages, the printing device comprising:

at least one print head, said at least one print head being displaceable in reciprocation across the image-receiving member in a main scanning direction and having a plurality of discharging elements for printing in each printing stage a portion of an image by image-wise forming dots of a marking substance on the image-receiving member, each printing stage corresponding with a forward or backward traverse of said at least one print head in an operative state in the main scanning direction;

a displacement device that establishes relative displacement between said at least one print head and the image-receiving member over the same constant predetermined distance in a sub-scanning direction after each printing stage; and a control that selects for each forward and backward traverse of said at least one print head in the main scanning path a different active portion of the plurality of discharging elements for different printing stages and for controlling image-wise activation thereof, wherein each active portion of discharging elements is selected on the basis of the predetermined distance so that for substantially each position in the sub scanning direction on the part of the image-receiving member where the image is to be rendered, the direction in which said at least one print head traverses the image receiving member is the same for each first exposure to an active portion of the traversing print head; and wherein in the subscanning direction, the time interval difference between the time of deposition of image dots originating from different traverses are minimized to reduce occurrence of gloss variations of said printed images.

2. The printing device as recited in claim 1, wherein the selected active portion for a forward traverse is different from the selected active portion for a backward traverse.

3. The printing device as recited in claim 1, wherein, when printing subsequent portions of an image, a repetitive sequence of printing stages and corresponding displacement steps is used, each displacement step being defined by the relative displacement between said at least one print head and the image-receiving member over a constant predetermined distance between respective subsequent printing stages.

4. The printing device as recited in claim 1, wherein each active portion is selected such that the product of the number of discharging elements available in that active portion and the discharging element pitch is a non-zero integer multiple of the displacement distance.

5. The printing device as recited in claim 1, wherein when printing an image with an even number of printing stages, the active portion in a forward traverse is either the upper part or the lower part of said at least one print head while the active portion in a backward traverse is the other one of said upper part or said lower part of said at least one print head.

6. The printing device as recited in claim 1, wherein when printing an image with an even number of printing stages each active portion is selected such that the swath width of each printed portion of an image is equal.

7. The printing device as recited in claim 2, wherein, when printing subsequent portions of an image, a repetitive sequence of printing stages and corresponding displacement steps is used, each displacement step being defined by the relative displacement between said at least one print head and the image-receiving member over a constant predetermined distance between respective subsequent printing stages.

8. A printing device for printing images on an image-receiving member in multiple stages, the printing device comprising:

at least one print head, said at least print head being displaceable in reciprocation across the image-receiving member in a main scanning direction and having a plurality of discharging elements for printing in each printing stage a portion of an image by image-wise forming dots of a marking substance on the image-receiving member, each printing stage corresponding with a traverse of said at least one print head in an operative state in the main scanning direction;

a displacement device that establishes relative displacement between said at least one print head and the image-receiving member over a constant predetermined distance in a sub-scanning direction after each printing stage; and a control that selects for each said traverse of said at least one print head in the main scanning direction an active portion of the plurality of discharging elements and for controlling image-wise activation thereof, wherein each active portion of discharging elements is selected on the basis of the predetermined distance so that for substantially each in the sub scanning direction on the part of the image-receiving member where the image is to be rendered, the traversing direction of said at least one print head is same for each first exposure to an active portion of the traversing print head, wherein, when printing an image with an uneven number of printing stages, M, the active portion in each forward traverse and the active portion in each backward traverse are selected such that the ratio of the swath width of each portion of an image printed in the forward traverse and the swath width of each portion of an image printed in the backward traverse is M+1 divided by M−1 or vice versa.

* * * * *